United States Patent [19]

Davies

[11] 4,321,444

[45] Mar. 23, 1982

[54] INDUCTION HEATING APPARATUS

[76] Inventor: Evan J. Davies, Little Aston, England

[21] Appl. No.: 953,903

[22] Filed: Oct. 23, 1978

Related U.S. Application Data

[63] Continuation-in-part of Ser. No. 774,242, Mar. 4, 1977, abandoned, which is a continuation-in-part of Ser. No. 643,808, Dec. 23, 1975, abandoned.

[30] Foreign Application Priority Data

May 21, 1975 [GB] United Kingdom ..... 8847/75

[51] Int. Cl.[3] ..... H05B 6/10; H05B 6/36

[52] U.S. Cl. ..... 219/10.41; 219/10.71; 219/10.79

[58] Field of Search ..... 219/10.79, 10.73, 10.71, 219/10.69, 10.67, 10.61, 10.75, 10.57, 10.41, 10.43, 6.5, 7.5

[56] References Cited

U.S. PATENT DOCUMENTS

| | | | |
|---|---|---|---|
| 1,365,199 | 1/1921 | Sessions | 219/10.79 |
| 2,005,901 | 6/1935 | Long | 219/10.73 |
| 2,419,116 | 4/1947 | Cassen et al. | 219/10.79 |
| 2,448,010 | 8/1948 | Baker et al. | 219/10.79 |
| 2,747,068 | 5/1956 | Lackner | 219/10.79 X |
| 2,811,623 | 10/1957 | Guthrie | 219/10.73 X |
| 2,832,877 | 4/1958 | Dreyfus | 219/10.69 X |
| 2,858,405 | 10/1958 | Kimbrough et al. | 219/10.75 X |
| 2,902,572 | 9/1959 | Lackner et al. | 219/10.79 |
| 3,041,434 | 6/1962 | Alf | 219/10.79 |
| 3,444,346 | 5/1969 | Russell et al. | 219/10.79 |
| 3,691,339 | 9/1972 | Cachat | 219/10.79 X |
| 3,965,321 | 6/1976 | Brinkman et al. | 219/10.69 |
| 4,122,321 | 10/1978 | Cachat | 219/10.79 |

*Primary Examiner*—Gerald P. Tolin
*Assistant Examiner*—Philip H. Leung
*Attorney, Agent, or Firm*—C. O. Marshall, Jr.

[57] ABSTRACT

An induction heater, particularly for heating metal slabs, is constructed in modular form. Two sets of modules are spaced apart to form a gap for reception of a slab. Each module is slotted and is wound with a group of polyphase coils so as to produce a travelling wave magnetic field and each group of coils is connected to a polyphase electrical supply independently of the other groups. The modules of one set are disposed directly opposite modules of the other set so that each pair of confronting modules have their like poles in opposition.

12 Claims, 14 Drawing Figures

INDUCTION HEATING APPARATUS

CROSS REFERENCE TO RELATED APPLICATION

This application is a continuation-in-part of Ser. No. 774,242 filed Mar. 4, 1977 which is in turn a continuation-in-part of Ser. No. 643,808 filed Dec. 23, 1975, both abandoned.

BACKGROUND OF THE INVENTION

This invention relates to induction heating apparatus, particularly for heating heavy metal slabs, billets and such like whose thickness is not less than 20 mm., where in contrast to widespread practice the heating coils are energised by a polyphase electrical supply and are wound in a fashion corresponding to electric motor windings so as to produce a travelling wave magnetic field.

Generally, induction coils for heating metal billets and the like have involved the use of single phase windings which produce a pulsating magnetic field. In many cases, the windings have been fed from the three phase supply generally found in industry so as to avoid unbalanced loading but the windings are effectively single phase windings and simply produce an overall pulsating field—see for example U.S. Pat. No. 2,811,623 which illustrates the difficulties encountered to achieve uniform heating in the regions of the junctions between adjacent windings. Other single phase-type heaters are disclosed for instance in U.S. Pat. Nos. 2,747,068, 2,902,572 and 2,832,877.

Proposals have been made to overcome the non-uniform heating found in single-phase-type systems, by the use of polyphase windings to produce a travelling wave magnetic field instead of a pulsating field as in the single phase systems. The basic proposal appears to have been made in U.S. Pat. No. 2,005,901 to T. H. Long which discloses a strip or sheet heater in which strip or sheet material is heated from both sides by respective polyphase energized windings wound in slots formed in laminated core structures of iron or steel, the windings being wound in a double layer configuration. As a general rule, a typical thickness gauge range for sheet and strip metal is 0.004–0.50 inch, i.e. up to about 12.5 mm. In the Long heater therefore, the well-known skin-effect phenomenon would not be particularly significant in that the magnetic fluxes from both sides of the heater could penetrate the sheet or slab to such an extent that there would be considerable interaction between the two sets of flux lines. It can therefore be inferred from this that the two sets of polyphase windings in the Long heater must be wound in such a way that each pole produced by the windings on one side faces an opposite pole on the other side. If this were not the case, the Long heater would not be functional since thin material requires transverse magnetic flux but cannot support fluxes entering the material from both sides.

SUMMARY OF THE PRESENT INVENTION

The objects of the invention are to provide an induction heating apparatus which is suitable for heating metal slabs with increased efficiency and which is constructed so as to be readily adaptable to slabs of differing thicknesses and lengths and easily maintained and repaired.

One aspect of the present invention is based on the recognition that, for the usual 50 to 60 Hz mains supply used in industry, when the thickness of the workpiece exceeds 20 mm., i.e. when the workpiece is a slab as opposed to a sheet, the skin effect phenomenon isolates the magnetic fluxes on each side of the workpiece from one another and advantage can be taken of this to produce more efficient and uniform heating. More specifically in accordance with the invention the polyphase windings on each side of the workpiece are so arranged that the poles on one side each substantially faces a like pole on the other side. Thus, the apparatus according to this aspect of the present invention is intended for heating metal slabs whose thickness is not less than about 20 mm. If used for workpieces of lesser thickness, the heating efficiency of the apparatus is significantly impaired due to interaction and consequent cancellation of the opposed transverse magnetic flux components. The advantages afforded by the present invention stem from the production in the workpiece of induced emfs which give rise to surface currents that circulate about the periphery of the workpiece in addition to surface currents that circulate in those faces of the workpiece which confront the polyphase windings. The former surface currents promote more uniform heating and their presence increases the heating efficiency for a given electrical power input.

According to another aspect of the invention, the apparatus is constructed in modular form and comprises two sets of magnetically permeable modules located one on each side of the slab, each module being slotted and wound with polyphase coils, preferably in a single layer one slot/pole/phase configuration, because, for a 3-phase supply, the coils can be accommodated in just six slots and each module can therefore be kept to a size just sufficient to provide six slots. In contrast, if a double layer winding is adopted the minimum size of each module would have to be greater and some slots would have to carry only one coil side/slot.

DESCRIPTION OF PREFERRED EMBODIMENTS OF THE INVENTION

Figure 1:
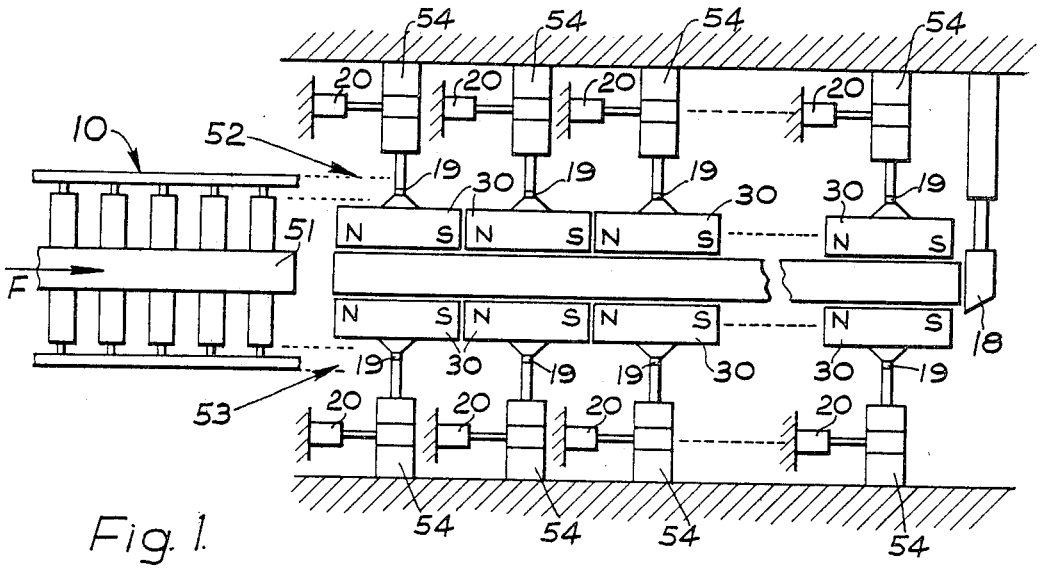
FIG. 1 is a diagrammatic plan view of a slab heater in accordance with the present invention.
Figure 2:
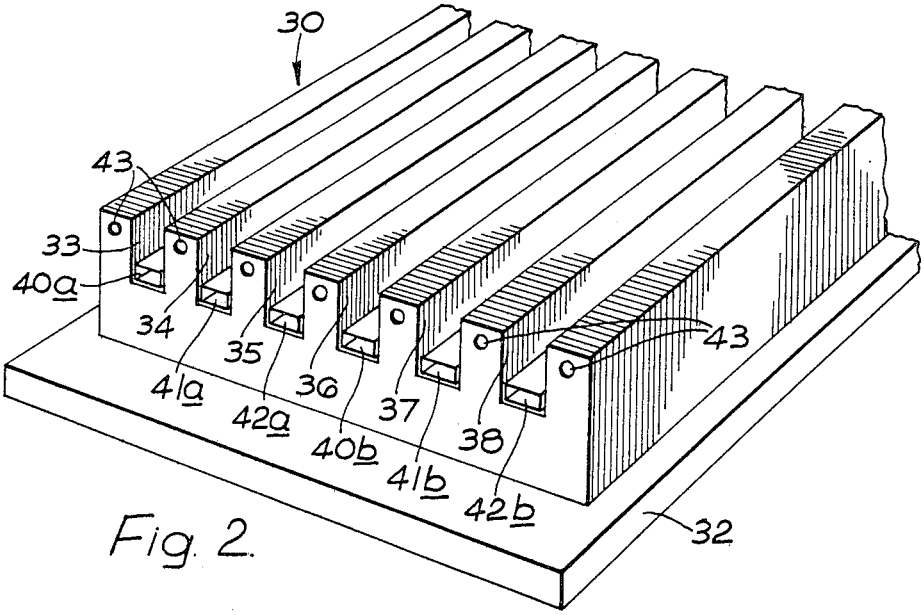
FIG. 2 is a fragmentary perspective of one of the linear-type induction heating modules forming the slab heater of FIG. 1.
Figure 3:
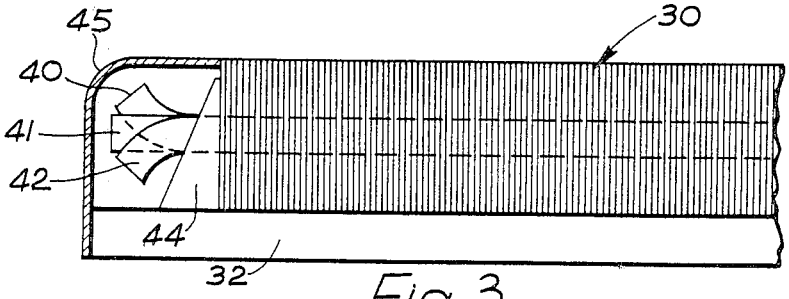
FIG. 3 is a side view of the module shown in FIG. 2.
Figure 4:
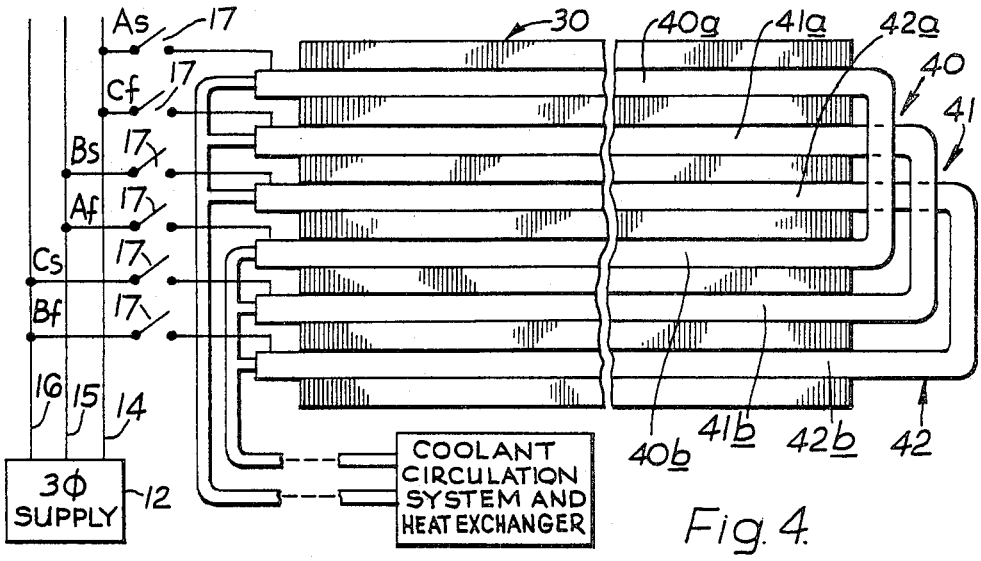
FIG. 4 is a plan view of the module shown in FIG. 2 showing in schematic form its connections to a three phase supply and coolant circulation system.

Referring now to the drawings, particularly FIGS. 1 to 4, a slab heater comprises two vertically-disposed arrays 52, 53 of side-by-side magnetically permeable modules 30, each of the form shown in FIGS. 2–4, the arrays being spaced apart in the horizontal direction to form a gap into which a slab 51 can be fed and supported edge on by suitable means such as a roller conveyor 10, as illustrated, or a carriage, the direction of feed being indicated by arrow F in FIG. 1.

Each module 30 comprises an elongated laminated core formed with 2MN slots which extend lengthwise of the module and transversely of the laminations, where M corresponds to the number of phases associated with the polyphase source used to energise the heater modules and N is an integer greater than or equal to unity which governs the number of pole pairs per module. In the illustrated embodiment, a three phase source is employed and each module 30 has one pole pair associated with it; thus six slots 33–38 are provided. The modules are arranged so that the slotted faces of the set 52 confront those of the set 53 although they need not be exactly opposite one another. The length of each module is selected according to the maximum width of slab to be heated.

The slots of each module are wound with a polyphase coil arrangement, preferably in single layer one slot/pole/phase configuration. Although only one turn is shown, for simplicity, in practice the coils will have multiple turns, for instance as described hereinafter with reference to FIGS. 5 and 6. Where, as illustrated a 3-phase supply 12 is used, the coils 40, 41 and 42 are connected to the respective phases in the manner illustrated in FIG. 4. In this way, a travelling wave magnetic field is produced. The modules 30 of each set 52, 53 are arranged so that the individual magnetic fields unite to produce a travelling wave magnetic field which moves within the gap from one end to the other of the heater for example in the direction of arrow F, the wave motion direction being the same for both sets 52, 53. Referring specifically to FIG. 4, if phase A corresponds to busbars 14 and 15, phase B corresponds to busbars 15 and 16 and phase C corresponds to busbars 16 and 14, then to produce the desired wave motion, coil sides 40*a* and 40*b*, located in slots 33 and 36 respectively, are connected to busbars 14 and 15 respectively; coil sides 41*a* and 41*b*, located in slots 34 and 37 respectively, are connected to busbars 14 and 16 respectively; and coil sides 42*a* and 42*b*, located in slots 35 and 38 respectively, are connected to busbars 15 and 16 respectively. Although in FIG. 4, the coils are connected to the supply in delta connexion, a star connexion is equally possible.

The modules of each set 52, 53 are arranged so that adjacent poles (designated N-S in FIG. 1) of adjacent modules are unlike (so that the alternating flux pattern runs for the whole length of the heater) and, for reasons explained below, the two sets are arranged so that each pair of confronting modules have their like poles in opposition, i.e. an N pole of each module in set 52 is in opposition to an N pole of the module directly opposite thereto in set 53, and likewise for the S poles. It will be appreciated the N-S designations shown symbolise instantaneous frozen patterns as it is an essential part of the concept that these patterns travel at the synchronous speed.

Preferably the arrangement is such that the polarity wave form produced by the modules on one side of the slab precisely corresponds, at all points, to that produced by the modules on the other side. However, some offset is possible, for example 30° (elec.) without significantly detracting from the advantages afforded by the present invention.

It will be noted that, for a three phase supply, the single layer, one slot/pole/phase winding shown occupies only six slots and produces one pole pair. For a 2-phase supply, the basic modules need only be provided with four slots.

Conveniently the modules are kept to the minimum possible width consistent with the requirement for a reasonably large pole pitch, by limiting each module to one pole pair. However, in some circumstances where larger width modules can be used, each module may have more than one pole pair associated with it, in which case other winding configurations may be used, including multilayer windings. However, it is still preferred to use a one slot/pole/phase winding because this produces a magnetic flux of square wave form, i.e. one containing harmonics of significant magnitude, which produces greater losses than other winding configurations used in rotary machines, where the emphasis is on keeping losses to a minimum by producing fluxes of approximately pure sinusoidal wave form.

By assembling the slab heater in modular form, maintenance of the heater is greatly facilitated in that if a particular section of the heater malfunctions the module or modules in that section can be readily replaced. To enable replacement to be effected rapidly each module is conveniently connected to the polyphase source independently of the remaining modules and where coolant is applied to each module, these connections may also be made independently of the other modules. Furthermore, by employing a modular construction, the heater can be made more flexible in that it can be adjustable to accommodate slabs of different lengths and slabs of bowed profile.

To allow such adjustments to be made, the modules 30 are mounted by means for effecting relative movement between the two sets 52, 53 and for effecting relative movement between the modules of each set both in the direction of wave motion and perpendicularly thereto. For example, each module 30 may be mounted on the piston rod of a respective fluid pressure-operable ram 54 for displacement in the horizontal direction towards and away from the opposite set of modules whereby the sets of modules can be brought into close proximity to the surfaces of the slab, independently of the thickness of the slab. This is an attractive feature of the invention since the smaller the air gaps, the smaller the magnetising current.

In practice, the rams 54 are all retracted initially to provide a large space between the two sets of modules, the slab is introduced into the gap and the rams 54 are then extended to advance the two sets of modules towards one another so as to sandwich the slab 51 therebetween. Heating is then commenced by energising the phase windings of each module, i.e. by closing contactors 17, see FIG. 4. Upon completion of heating to a desired temperature, the rams 54 are retracted to separate the two sets of modules and allow withdrawal of the slab. A retractable stop 18 may be provided to restrain the slab against movement in the wave motion direction during heating.

Each module is mounted on its respective piston rod by a coupling allowing limited tilting of the module so that the modules may readily conform to the contour of the slab particularly when the slab is bowed. Each ram 54 may be mounted in a slideway or the like to allow limited adjustment in the direction of arrow F under the control of fluid pressure-operable rams 20 whereby the side-to-side spacing between adjacent modules can be varied to increase or reduce the overall span of the heater in the direction F. Thus, if a longer than normal slab is to be heated, the rams 20 may be operated to compensate for the increased length. Where a particularly short length slab is involved, one or more of the modules at the one end of each set may be disconnected, e.g. by leaving the associated switches 17 open during heating.

In use, the heat produced can be of such intensity that the polyphase coils would be damaged. To some extent, such damage can be avoided by using deep slots in the modules and fitting the coil sides deeply into the slots, i.e. well away from the hot surfaces of the slab. To further reduce the possibility of damage, each module is conveniently cooled in use by passing coolant through coolant passages, such as those indicated by reference numeral 43 in FIG. 2, and/or by employing tubular electrical conductors 40, 41, 42 and circulating coolant through them. The latter embodiment is illustrated schematically in FIG. 4.

As described above, the modules are arranged in vertical arrays and the slab is also disposed vertically. Whilst this will, in general, be the preferred arrangement, others are possible, e.g. horizontal arrays of modules with the slab being fed in a horizontal plane between the two arrays of modules.

Referring now to FIGS. 10(*a*)–(*d*), FIG. 10(*a*), shows schematically the instantaneous magnetic flux paths produced by the arrangement of the present invention where like poles are in opposition across the gap between the two sets of modules. It will be noted that the fluxes are confined to the surfaces layers S of the slab 51 owing to the skin effect; consequently the fluxes on one side of the slab are, for all practical purposes, isolated from those on the other side. Also the magnetic field motion, as indicated by arrows F and $F^1$, is the same on opposite sides of the slab. The lines of magnetomotive force have an axial component 100, i.e. a component in the direction of field motion F, $F^1$, and transverse components 102 and $\mathbf{102}^1$. The transverse mmf components 102, and likewise the transverse mmf components $\mathbf{102}^1$, are oppositely-directed but do not cancel one another because they cannot penetrate the thickness of the slab due to the skin effect. The transverse components 102, $\mathbf{102}^1$ induce emfs in the major surfaces of the slab which, in turn, produce surface currents of the form shown in FIG. 10(*c*), i.e. the surface currents close along the longitudinal edges of the slab to form loops 104 lying in the plane of the slab. The axial flux components 100 on the other hand induce emfs which cause surface currents on opposite faces of the slab to close across the edges of the slab to form currents loops 106 about the periphery of the slab. It has been found that the latter currents contribute significantly to the efficiency and the uniformity of heating. For the pole pitches and slab thicknesses applicable to the heaters of the present invention, the end paths for closure of the loops 104 are greater than those of the loops 106, thus favouring current flow in the latter mode, i.e. loops 106. In practice, the pole pitch is governed by, inter alia, the width of the modules, as considered in the direction of wave motion, in that the module width must be kept well within limits if the advantages of modular construction are to be obtained. Preferably the dimension of each module, as considered in the wave motion direction F, is not less than 50 M/3 cm. i.e. 50 cm for a 3-phase system because a significant heating contribution from the current loops 106 can then be attained.

It will be noted that if the alternative arrangement of FIG. 10(*b*) is used, where unlike poles are in opposition across the gap, then the axial flux components 100 on each side of the slab are in opposition and consequently the emfs induced by these flux components are in opposition and no substantial flow of current across the edge of the slab can occur. The only mode of substantial current flow possible in this arrangement is that indicated by loops 104 as shown in FIG. 10(*d*). The fact that there will be no substantial current flow across the slab edges (as would be necessary for the formation of loops 106) will be understood if it is considered that the voltages at, for instance, points 108, 110 in FIG. 10(*d*) will be substantially equal and there can be no current flow between points which are at the same potential. FIGS. 10(*c*) and (*d*) are of course idealised representations of the mechanisms involved, showing simplified eddy current paths. In practice the situation is very much more complicated and, as will be seen from the experimental results described hereinafter, there will in fact be some current flow across the slab edges even in the FIG. 10(*b*) arrangement but much less than in the FIG. 10(*a*) arrangement. It will also be noted that the arrangement of FIG. 10(*b*) is the only one which could be employed with success for thin materials. In practice, when the thickness of the material to be heated falls well below 20 mm., the arrangement of FIG. 10(*a*) becomes unsatisfactory because the magnetic fluxes on each side of the workpiece are no longer dissociated from one another by the skin effect and therefore the transverse m.m.f's 102, $\mathbf{102}^1$ will tend to cancel each other whereas with the FIG. 10(*b*) arrangement, each component 102 will combine additively with the component $\mathbf{102}^1$ on the other side of the slab.

To further illustrate the superiority of the FIG. 10(*a*) arrangement over that of FIG. 10(*b*), reference is now made to tests that have been carried out using the two configurations to heat the same mild steel plate. The experimental work was done using two travelling wave heaters placed on opposite sides of the plate. The plate was 630 mm long, 76 mm wide and 19 mm thick and had a resistivity of 19 $\mu\Omega$m. The width of the plate was the same as the heater stacks, i.e. 76 mm. The plate was heavily instrumented with probes to measure the current density distribution over the plate surfaces.

FIG. 10(*e*) shows the probes which are important for the present discussion:

probe Z measuring the z-component of current density at a point 5 mm from the edge of the plate;

probe X measuring the x-component of current density at the same point; and probe Y measuring the current passing across the edge of the plate from one face to the other.

The x, y, z components are Cartesian components, the x component being parallel to the direction of magnetic field motion (i.e. direction F, $F^1$ in FIG. 10(*c*)) the z component being perpendicular to the direction of field motion and in the plane of the plate and the y component being perpendicular to the direction of field motion and to the plane of the plate.

The current densities in the plate measured at these points for the same excitation on the heaters (82.3 $KAm^{-1}$) and the same excitation frequency (50 Hz) with the heaters arranged in the FIG. 10(*a*) and (*b*) configurations respectively.

Figure 10A:
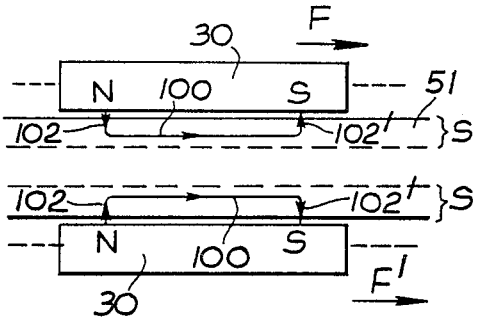
FIGS. 10(*a*), (*b*), (*c*) and (*d*) are schematic views showing magnetic flux paths and current flow paths, and FIG. 10(*e*) is a schematic view showing probes for measuring the currents.
Figure 10B:
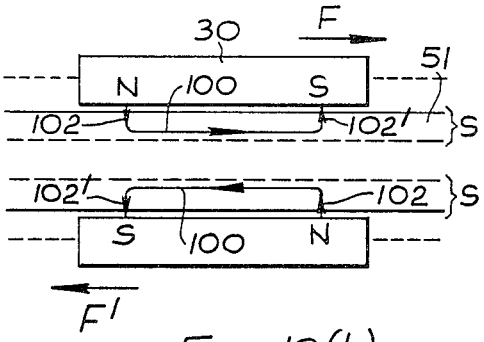
Fig. 10(b). PRIOR ART
Figure 10C:
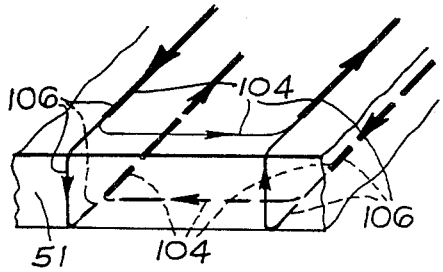
Figure 10D:
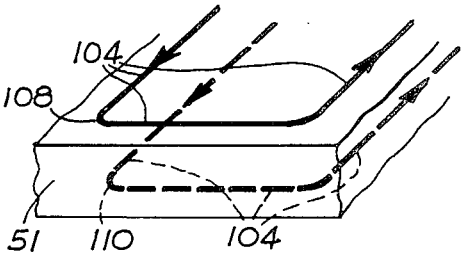
Fig. 10(d). PRIOR ART
Figure 10E:
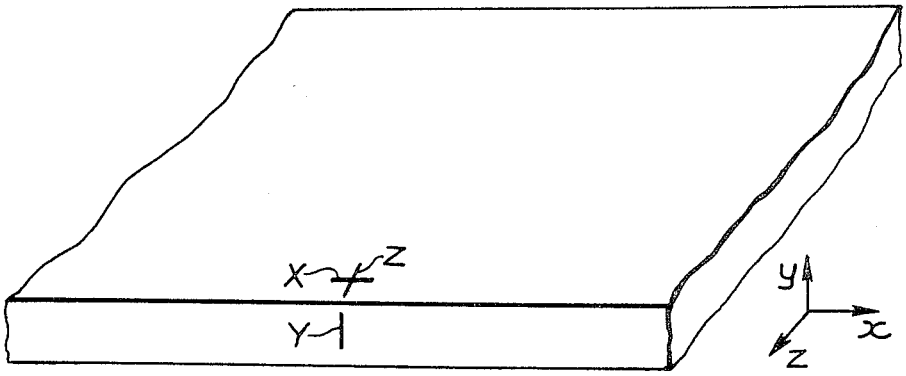

The measured results were as follows:

| Configuration | Z probe (mV) | X probe (mV) | Y probe (mV) |
|---|---|---|---|
| FIG. 10(a) | 19.5 | 4.8 | 18 |
| FIG. 10(b) | 15.0 | 22 | 5.6 |

The readings in mV are proportional to current density J. The readings do not necessarily add arithmetically as they are phasor quantities. From these results, it is apparent that:

FIG. 10(*a*)—most of the current flowing in the z-direction passes over the edge and completes its circuit on the opposite side.

FIG. 10(*b*)—because the voltages on the two sides of the plate are opposing, most of the current closes in the x-direction and relatively little current crosses the edge of the plate in the y-direction. Because the path length is shorter for current loop closure across the edge and because such closure is favoured by the FIG. 10(*a*) configuration, the same excitation produces more current in the z direction than with the FIG. 10(*b*) configuration—hence greater efficiency.

Figure 5:
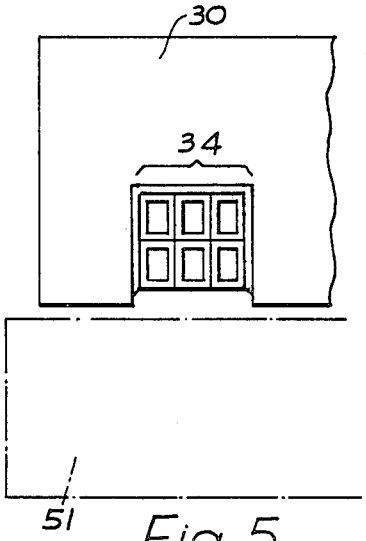
FIGS. 5 and 6 are detail views of modifications of the module winding.
Figure 6:
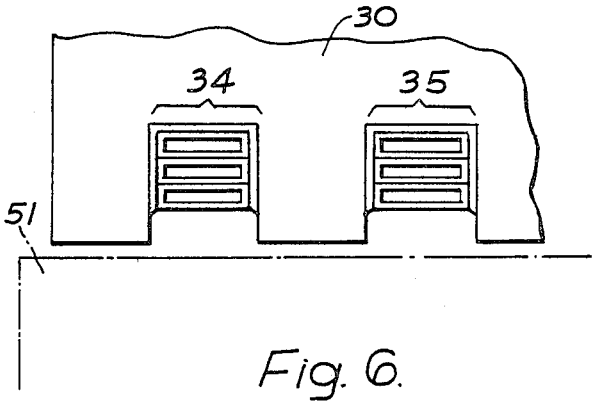

Referring now to FIGS. 5 and 6 these show possible conductor shapes and arrangements in both of which the coils are in multiturn-form but with one coil side/-slot. In FIG. 5, the conductors are oblate in a direction transverse to the wave motion direction. In both cases, the conductors are tubular so that they provide a flow path for coolant.

Figure 7:
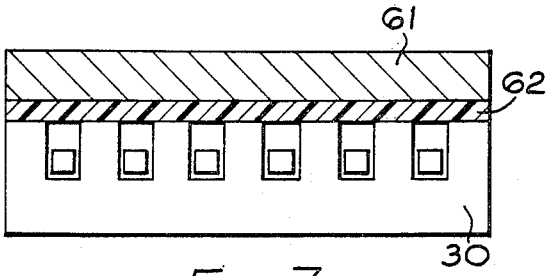
FIG. 7 is a sectional view of a modification of the module shown in FIG. 2.
Figure 8:
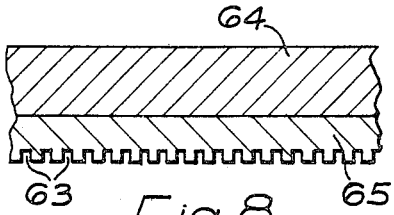
FIG. 8 is an enlarged fragmentary view of the platen seen in FIG. 7.
Figure 9:
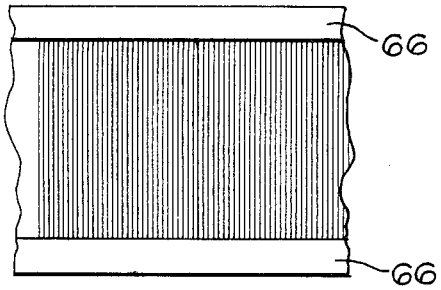
FIG. 9 is an underside view of the platen.

FIG. 7–9 show a modification of the basic module in which a platen 61 is mounted above the slotted face of the module with a layer 62 of thermally insulating material therebetween. The platen is of electrically conductive material so that eddy currents are induced therein by the travelling wave magnetic flux generated by the windings of the module 30. To control the direction of current flow in the platen, it may be formed with a plurality of slits 63 extending at right angles to the wave motion direction, i.e. parallel to the slots in the module. Furthermore the platen may be formed in two layers 64 and 65 of relatively high and low resistivity respectively, the lower resistivity layer being provided with slots 63 presented towards the module. In addition, the edges of the platen may be provided with copper or other low resistivity areas 66 which extend in the wave motion direction.

I claim:

1. An induction heating apparatus comprising first and second spaced apart magnetically permeable core structures having faces which have a series of generally parallel slots therein, said faces confronting one another and bounding a gap into which a metal slab not less than about 20 mm. thick to be heated can be introduced with its major faces each opposing a respective slotted face of said core structures, the slots of the face of each core structure being wound with a respective set of linearly distributed electrically conductive coils connectible to different phases of a mains frequency polyphase supply whereby travelling wave magnetic fields are produced by said coils which travel along said gap in the same direction generally parallel to the respective slotted faces and transverse to said slots so as to react with said faces of the slab, the surface layers of which afford continuous flux paths, lengthwise of said gap, for said fields, the two sets of coils being wound with like poles substantially in opposition whereby the transverse component of magnetic flux derived from each set of coils is substantially in opposition to that derived from the other set thereby inducing oppositely directed currents in said major faces which flow transversely of said direction of travel of the magnetic fields and close across the edge faces of the slab to form current loops which travel in the same direction as said magnetic fields to enhance uniform heating of the slab.

2. Apparatus as claimed in claim 1 including means for effecting relative movement between said core structures to vary the width of the gap between said slotted faces, whereby slabs of different thicknesses can be introduced into the gap whilst maintaining the air gaps to be traversed by the magnetic fluxes substantially constant.

3. Apparatus as claimed in claim 1 in which each core structure comprises a series of separate modules disposed side-by-side and having slotted areas which collectively form the slotted face of the respective core structure, each slotted area being wound with an individual group of polyphase coils which are connectible to the polyphase source independently of the groups of coils associated with the remaining modules.

4. Apparatus as claimed in claim 3 in which the group of polyphase coils associated with each module are wound so as to produce two poles, in which each module of the first core structure substantially confronts a respective module of the second core structure and in which the polarity at any point on one module is substantially the same as the polarity at a corresponding point on the module confronting the same.

5. Apparatus as claimed in claim 4 in which each module has six parallel slots and said coils are wound in single layer, one slot/pole/phase configuration.

6. Apparatus as claimed in claim 3 including means for effecting adjustment of the modules of each core structure in the direction of motion of said travelling wave whereby the overall length of the core structure, as considered in said direction, can be varied.

7. Apparatus as claimed in claim 3 in which each module has 2 MN slots, where M corresponds to the number of phases and N is an integer greater than or equal to 1, and said coils are wound in a single layer, one slot/pole/phase configuration to form N pole pairs.

8. Apparatus as claimed in claim 7 in which the dimension of each module, as considered in the direction of wave motion, is greater than or equal to 50 M/3 cm.

9. An induction heating apparatus comprising a first group of magnetically permeable core modules which are disposed side-by-side and have faces which are presented in substantially the same direction and have a series of generally parallel slots therein, the slots of each first module being wound with a set of linearly distributed, electrically conducting coils which are connectible to a mains frequency polyphase power source independently of the coils associated with each other first module and said sets of coils being arranged to produce a travelling wave magnetic field which travels in a direction generally parallel to said slotted faces and transversely of said slots, and a second group of magnetically permeable core modules disposed side-by-side and having faces which have a series of generally parallel slots therein and are in spaced opposed relation to the slotted faces of the first group to form a gap for reception of a workpiece not less than about 20 mm thick, the slots of each second module being wound with a set of linearly distributed, electrically conductive coils which are connectible to a mains frequency polyphase power source independently of the coils associated with each other second module and said first modules, said sets of coils associated with the second group of modules being arranged to produce a travelling wave magnetic field which travels generally parallel to the slotted faces of the second modules and in the same direction as the field produced by the first modules, each module of the first group being disposed directly opposite a respective module of the second group with their like poles in opposition whereby the transverse components of magnetic flux (i.e. those components which are generally perpendicular to said slotted faces) produced by each module of one group are in opposition to those produced by its counterpart in the opposite group.

10. Apparatus as claimed in claim 9 including means for effecting relative movement between said two groups of modules whereby the dimension of the gap therebetween can be varied upwards of 20 m.m.

11. Apparatus as claimed in claim 9 in which each module has 2 MN slots, where M corresponds to the number of phases and N is an integer greater than or equal to one, and in which the set of coils associated with each module are wound in single layer, one slot/-pole/phase configuration to form N pole pairs.

12. A method of induction heating a metal slab which is at least about 20 m.m. thick and has a pair of major faces, a pair of edge faces and a pair of end faces, in which method the slab is introduced into a gap between first and second spaced-apart magnetically permeable core structures, which have faces having a series of generally parallel slots therein, such that the major faces of the slab are each in opposed relation with a respective slotted face of said core structures and the edge faces thereof extend generally transversely to the slots of the core structures; and mains frequency polyphase electrical power is supplied to respective sets of electrically conductive coils wound in linearly-distributed fashion in the slots of said faces of said core structures so that each set of coils produces a travelling wave magnetic flux which links with the surface layer of the adjacent major face of the slab and travels therealong generally parallel to said slotted faces and transversely of said slots, the travelling wave magnetic fields produced by said sets of coils being substantially isolated from one another by the thickness of the slab but being afforded a continuous flux path lengthwise of the gap by said surface layers and said coils being wound so that the magnetic fields travel in the same direction and so that the opposed polarities of said fields at any point along the direction of travel are substantially the same whereby oppositely-directed currents are induced in said major faces which flow between said edge faces and close across the edge faces to form current loops about the slab which travel in the same direction as said magnetic fields to enhance uniform heating of the slab.

* * * * *